United States Patent [19]

Tabuchi et al.

[11] 3,961,158

[45] June 1, 1976

[54] HEATING ROLLER APPARATUS WITH PRECISE TEMPERATURE MEASUREMENT

[75] Inventors: Muneharu Tabuchi, Otsu; Shosen Bando, Kyoto; Tadashi Tabei; Yasuhiro Asai, both of Mishima, all of Japan

[73] Assignee: Toray Industries, Inc., Tokyo, Japan

[22] Filed: Apr. 5, 1973

[21] Appl. No.: 348,032

[30] Foreign Application Priority Data

Apr. 14, 1972 Japan ..... 47-36973

[52] U.S. Cl. ..... 219/471; 219/469

[51] Int. Cl. ..... H05b 1/02

[58] Field of Search ..... 219/469, 470, 471; 73/351

[56] References Cited

UNITED STATES PATENTS 3,813,518 5/1974 Arita ..... 219/471 OR

*Primary Examiner*—R. Skudy
*Assistant Examiner*—F. E. Bell
*Attorney, Agent, or Firm*—Burgess, Ryan and Wayne

[57] ABSTRACT

A heating roller apparatus with precise temperature measurement is disclosed which has a rotatable roller member comprising a cylindrical wall defining a room in the inside thereof and an annular groove therein, a heat source means, such as electrically excited induction coils, for heating the cylindrical wall, and a temperature sensor stationarily positioned in the annular groove of the cylindrical wall for measuring a temperature of the cylindrical wall of the roller member. The annular groove has an opening on the outer surface of the cylindrical wall, and two adjacent circumferentially extending wall faces which penetrate into the cylindrical wall in the direction substantially perpendicular to the rotating axis of the rotatable roller member. The annular groove is located at a part of the cylindrical wall adjacent to the end face of the roller member so that the outer surface of the remaining part of the cylindrical wall operates as a heat treating working surface.

18 Claims, 18 Drawing Figures

HEATING ROLLER APPARATUS WITH PRECISE TEMPERATURE MEASUREMENT

The present invention relates to a heating roller apparatus which is preferably used as a draw roller apparatus for heating running synthetic yarns and, in particular, to a heating roller apparatus having a temperature sensor disposed in the roller apparatus so as to allow precise measurement and control of the temperature of the heating roller apparatus.

In a heating roller apparatus used especially in production of the filaments of various kinds of synthetic yarns, it is necessary to precisely measure and control the temperature of the heating roller. This necessity is because the quality of the product is dependent upon accurate control of the surface temperature of the heating roller apparatus.

In temperature measurement and temperature control of heating roller apparatuses, it is well known to provide means for detecting the surface temperature of the heating roller apparatus in such a manner that the temperature sensor is inserted in an annular groove or recess. This groove or recess is formed in the cup like heating roller member so that the groove has an opening on an end face of the heating roller member while having its depth extending in the direction parallel to the central rotating axis of the heating roller member. Until now, the above-mentioned arrangement of the annular groove has been broadly accepted as a relatively inexpensive arrangement, and also as an arrangement capable of obtaining a stable detection of the temperature. The Japanese Patent Publications No. 43-14178, No. 43-18037 and No. 46-13937, and the Japanese Utility Model Publications No. 43-17735 and No. 43-17736, refer to such type of disposition of the temperature sensor.

On the other hand, the Japanese Patent Publications No. 44-2497, No. 46-33128, and the Japanese Utility Model Publication No. 43177, refer to a different type of disposition of the temperature sensor. In this disposition the temperature sensor is inserted in a measuring groove formed in the inner surface or in the bottom surface of the cup like cylindrical heating roller member.

However, it has recently been ascertained by the present inventors that the above-mentioned two known dispositions often fail to provide appropriate measurement of the temperature of the outer surface of the heating roller apparatus. The present inventors have investigated the causes of said failure through repeated experiments and have come to the conclusion that the known dispositions have several drawbacks as described later. As a result the present inventors concluded that in order to attain precise measurement of the temperature of the heating roller apparatus, an improved disposition of the temperature sensor in the heating roller apparatus must be invented.

Therefore, an object of the present invention is to obviate the drawbacks in temperature measurement encountered with the known heating roller apparatus.

Another object of the present invention is to provide a heating roller apparatus having an improved disposition of the temperature sensor whereby the conditions of excellent response characteristics, reliability in performance and low manufacturing cost can be satisfied.

In accordance with one of the features of the present invention, a heating roller apparatus comprising: a roller member including a cylinder wall defining a room in the inside thereof and an annular groove therein; a rotatably supported drive shaft supporting the roller member through concentric and rigid connection of one end part of the roller member and an end of the drive shaft; a heat source means stationarily positioned in the inner room of the roller member for heating the cylinder wall, and; a temperature sensor having at least one measuring probe stationarily positioned in the annular groove of the cylindrical wall for measuring a temperature of the cylinder wall of the roller member, characterized in that the annular groove is located at a position adjacent to the other end part of the roller member and has an opening on the outer surface of the cylindrical wall, and two adjacent circumferentially extending wall faces which penetrate into said cylindrical wall in the direction substantially perpendicular to the rotating axis of the roller member, said wall faces of the annular groove being spaced from the measuring probe of said temperature sensor.

The present invention will fully be understood from the ensuing descriptions with reference to the accompanying drawings wherein.

Figure 11:
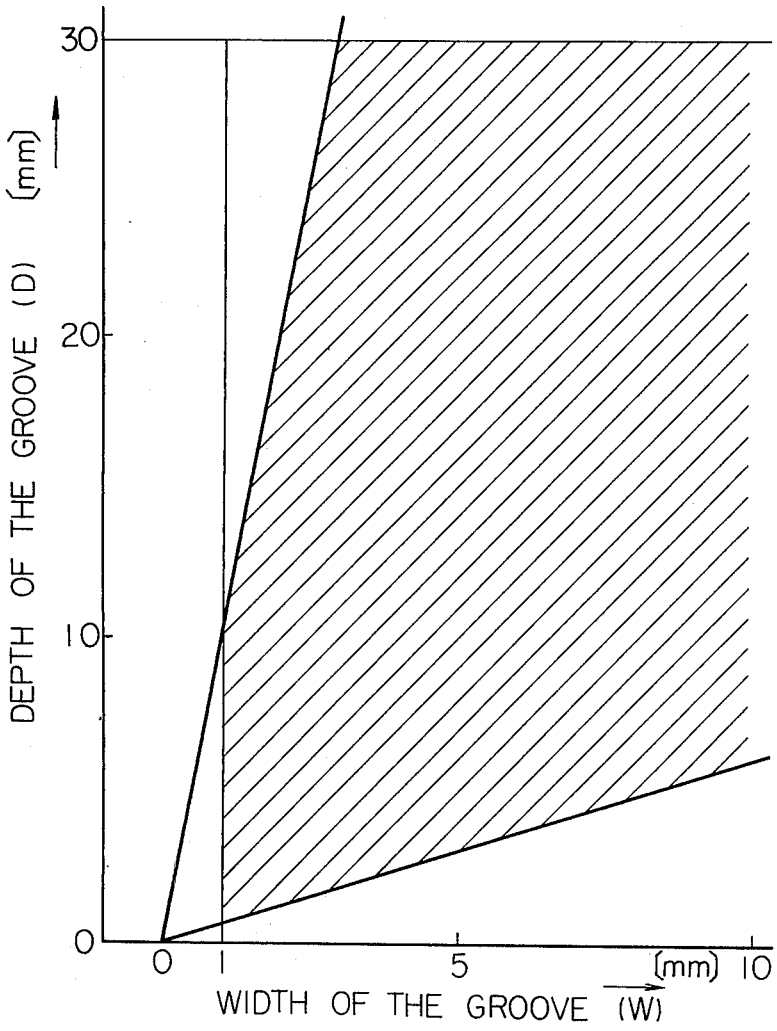

FIGS. 10A thru 10E are longitudinal sections of a part of the heating roller of the present invention illustrating the manner of provision of the adiabatic material in order to improve the state of thermal flow, and;

FIG. 11 is a diagram illustrating the relationship between the depth and the width of the groove for temperature measurement of the heating roller apparatus according to the present invention.

Figure 1A:
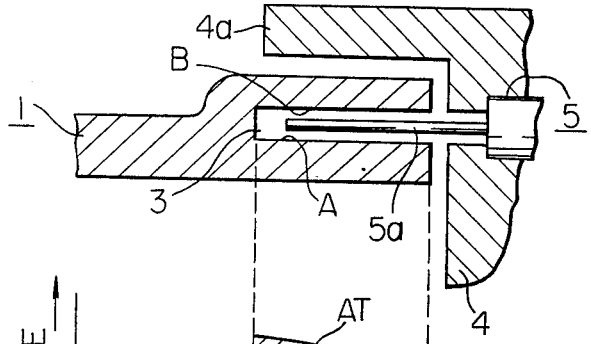
Fig. 1A (PRIOR ART)
FIG. 1A is a schematic vertical section view of a part of the heating roller apparatus of the prior art, illustrating a typical example of the known disposition of the temperature measuring means.
Figure 1B:
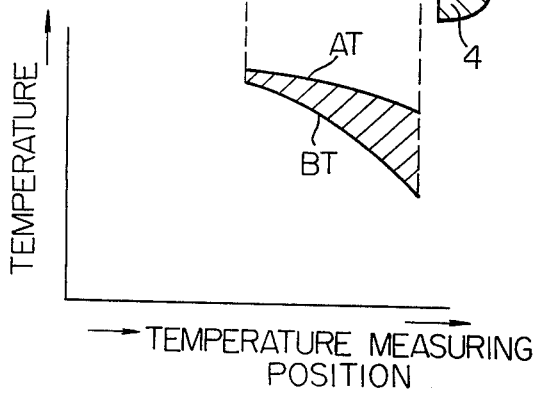
Fig. 1B (PRIOR ART)
FIG. 1B is a diagram in connection with the heating roller of the prior art of FIG. 1A, illustrating the temperature distribution within the annular groove for temperature measurement.

In FIG. 1A, reference numeral 1 is a part of a cup-shaped cylindrical heating roller member. The heating roller member 1 is provided with an annular groove 3, formed in an end face of the open side, which is opposite a stationary flange 4, so that the groove 3 is concentric with the rotating axis of the heating roller member 1. A probe 5*a* of a temperature sensor 5 is inserted in the annular groove 3 so that it is not necessary to rotate the temperature sensor 5 together with the heating roller member 1. Numeral 4*a* is an outer covering member for the end part of the heating roller member 1. Of course, a heating source (not shown) is arranged in the inside of the heating roller member 1 in order to heat the heating roller member 1. FIG. 1B is a diagram with regard to the known arrangement of FIG. 1A illustrating relationships between temperature measuring positions along the longitudinal inside walls of the annular groove 3 and distribution of the measured temperatures.

Figure 2A:
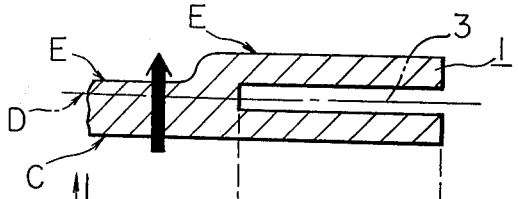
Fig. 2A (PRIOR ART)
FIG. 2A is a schematic vertical section view of a part of the heating roller apparatus of the prior art, similar to FIG. 1A.
Figure 2B:
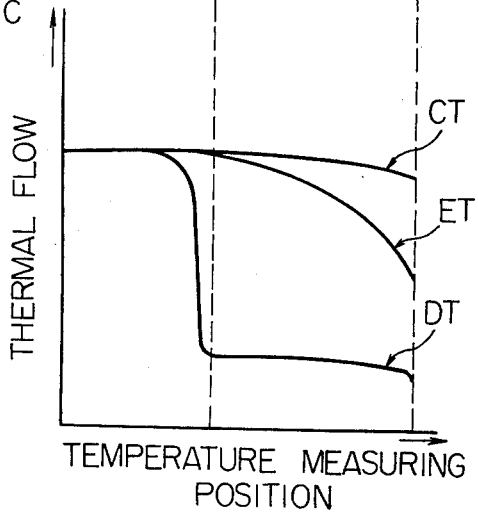
Fig. 2B (PRIOR ART)
FIG. 2B is a diagram illustrating the thermal flows in the heating roller of FIG. 2A.

That is, the abscissa of FIG. 1B indicates the temperature measuring positions, and the ordinate indicates the temperatures. A solid line AT shows a temperature distribution curve with regard to the inner side wall A of the annular groove 3. A solid line BT shows a temperature distribution curve with regard to the outer side wall B of the annular groove 3. It will be understood that a vertical difference between both solid lines AT, BT at a certain temperature measuring position corresponds to a temperature difference between the inner wall A and the outer wall B. Thus, as can be seen from FIG. 1, as the measuring position approaches the opening of the groove 3, the temperature difference increases and the temperature of each wall decreases. FIGS. 2A and 2B illustrate causes of generation of the temperature distribution as shown in FIG. 1B. That is, FIG. 2A again schematically shows a part of the heating roller member 1, and FIG. 2B shows thermal flow distribution curves. In FIG. 2A, a thick arrow directed upward schematically shows the direction of the thermal flow, and reference letters C, D and E are measuring lines along the inner surface of heating roller member 1, the center line of groove 3, and the outer surface of heating roller member 1, respectively.

On the other hand, the abscissa of FIG. 2B indicates the temperature measuring positions, and the ordinate indicates the amount of thermal flow. The vertical dotted lines between FIG. 2A and FIG. 2B indicate the region corresponding to presence of groove 3. In FIG. 2B, the lines or curves CT, DT and ET indicate distributions of thermal flows passing the cylindrical inner surface of heating roller member 1, the cylindrical plane containing the center line of groove 3, and the cylindrical outer surface of heating roller member 1, respectively. That is, the thermal flow distributions along the lines C, D and E correspond to the curves CT, DT and ET, respectively. When the probe 5*a* of the temperature sensor 5 is inserted into the groove 3, the probe 5*a* detects the temperatures averaging the thermal flow distributions shown by the curves CT, DT and ET. However, in this case, the temperatures detected by the probe 5*a* becomes slightly lower than the averaged temperatures in the groove 3, since the heat conduction by the probe 5*a* itself causes reductions in the detected temperatures which are to be considered deviations.

As is apparent from FIGS. 1A thru 2B, the known disposition of the temperature sensor encounters the following drawbacks.

. As the inclination of the temperature distribution curve within the annular groove 3 is large, as shown in FIG. 1B, variationof the position within the annular groove at which the temperature measuring probe is installed results in a large change in the detected temperature. Consequently, in the case where a number of the heating roller apparatuses are simultaneously used, large differences in the outer surface temperatures occur between the different heating roller apparatuses. Also, every time the temperature sensor is replaced, the detected temperature becomes different. Further, it is difficult to adjust the installation position of the temperature measuring probe and, therefore, the installation of the probe requires a skilled technique and a large amount of working time in order to obtain the most optimum measurement.

2. The thermal flows are in different states between the surfaces of the heating roller member and places around the annular groove, as is easily understood from FIG. 2B. As a result, relative correspondence between the temperatures of the outer surface of the heating roller member, on which surface the products contact, and the temperatures within the annular groove is easily changed in response to the change of rotating speed of the heating roller member and/or the change of the temperature of the environment adjacent to the outer surface of the heating roller member 1. Thus, compensation or correction is often required and, as a result, control of the temperature of the outer surface of the heating roller apparatus is very difficult.

From the foregoing it can be concluded that the known disposition of the temperature sensor in the annular groove, which is formed in the heating roller member so as to have axial depth with respect to the central rotating axis of the heating roller, cannot accomplish precise measurement and control of the surface temperature of the heating roller apparatus.

On the other hand, the previously mentioned other disposition of the temperature sensor within the annular groove formed in the inner or bottom surface of the heating roller member, has the following defects.

1. There is poor relative correspondence between the outer surface temperature of the heating roller member and the temperature detected by the temperature sensor. This is because it is impossible to prevent the direct heat up of the temperature sensor by a heat source, such as an induction type heater or a radiation type heater, which is provided in the inside room of the heating roller apparatus. As a result, the temperature sensor cannot correctly detect the temperature of the heating roller member.

2. The temperature measured by the temperature sensor installed within the groove formed in the inner surface of the heating roller member cannot immediately respond to a change in the temperature of the heating roller member. This is because the temperature sensor detects the temperature of the heating roller member by detecting the temperature of the air within a closed space defined by the inside of the heating roller member, and the temperature of the air within the closed space does not immediately change upon change of the temperature of the heating roller member.

3. The error in measurement by the temperature sensor is large. This is due to the fact that generally, in order to carry out precise measurement, the inserted length of the measuring probe of the temperature sensor should be fifteen to twenty times the diameter of the measuring probe; however, the groove in the inner surface of the heating roller member cannot accommodate such a length, since the depth of the groove reaches to at the utmost a half of the thickness of the heating roller member.

4. It is impossible to inspect whether the temperature sensor is appropriately positioned in the groove, from the outside of the heating roller apparatus. As a result, because of the possibility of an improperly positioned device, precise measurement cannot be expected and further, the temperature sensor might be damaged while it is positioned in the groove.

5. Replacement of the temperature sensor is very difficult since it cannot be taken out of the heating roller apparatus without removing the heat source in the heating roller member.

It should be understood that in order to accomplish the precise measurement and control of the temperature of the heating roller apparatus, the above-mentioned drawbacks and defects of the known heating roller apparatus must completely be eliminated.

The features and advantages of the present invention will now be explained. Reference is made to several preferred embodiments and performance characteristics diagrams which are based on comparisons between the present invention and the prior art.

Figure 3:
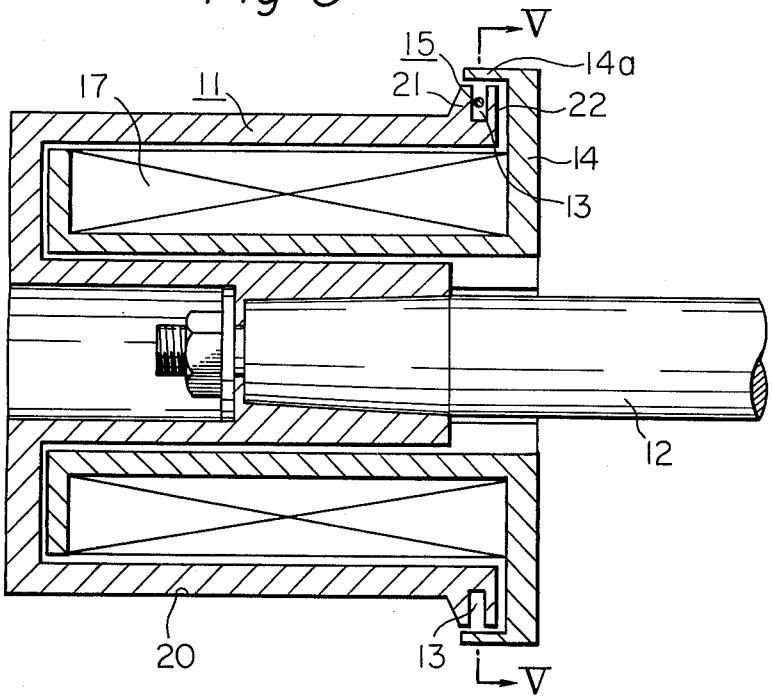
FIG. 3 is a longitudinally sectional view schematically showing a heating roller apparatus according to the present invention.
Figure 4:
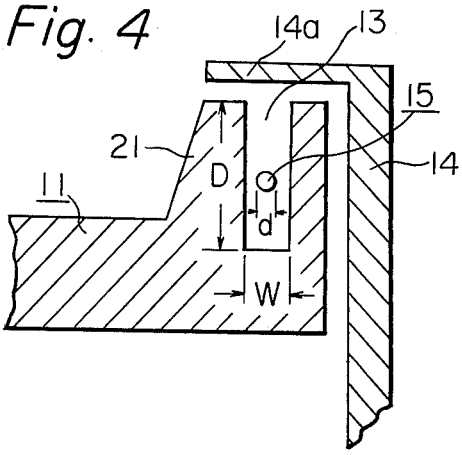
FIG. 4 is an enlarged partial sectional view schematically showing an integral part of the heating roller apparatus of FIG. 3.
Figure 5:
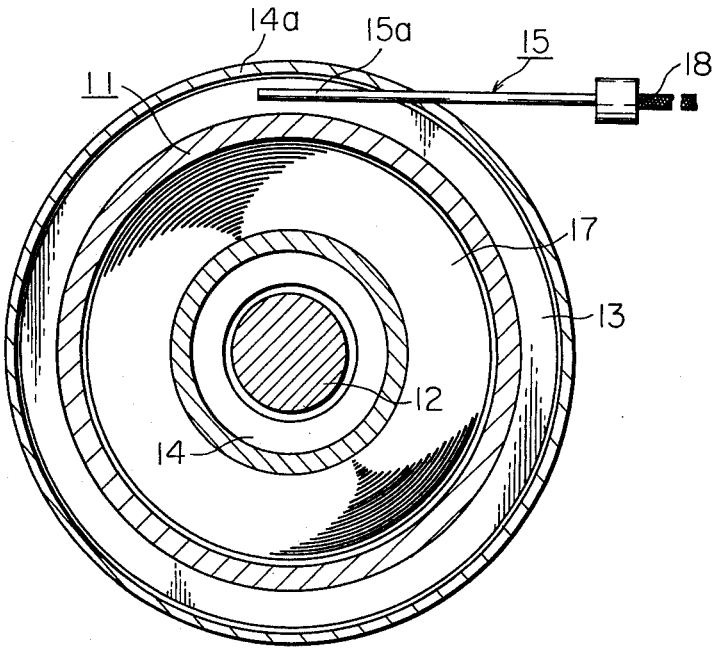
FIG. 5 is a cross section taken along line V—V of FIG. 4.

In FIGS. 3 thru 5, a drive shaft 12 is rotatably supported by bearing means (not shown), and is rotated by a suitable drive source (not shown). As shown, on one end of the drive shaft 12, a cylindrical heating roller member 11 is fixedly mounted. The heating roller member 11 is provided with an annular cavity or hollow in the inside of the outermost wall thereof, and also provided with an open end facing a stationary flange 14. In the annular cavity of the heating roller member 11, an induction coil 17 fixed to the flange 14 is stationarily positioned. When the induction coil 17 is excited, eddy currents are induced in the heating roller member 11 so that the heating roller member 11 is heated by the known joule heat due to the eddy currents. Of course, the induction coil 17 for heating up the heating roller member 11 may be replaced by a radiation type heater. On the outermost surface 20 of the heating roller member 11, there is formed a lug portion 21 adjacent to the end face 22 of the open end. That is, the diameter of the lug portion 21 is larger than that of the surface 20 on which products to be treated by the heating roller member 11 touch. As shown, in the lug portion 21 having the largest diameter, an annular recess or groove 13 is formed so as to have a selected depth toward the center rotating axis of the heating roller member.

Figure 6:
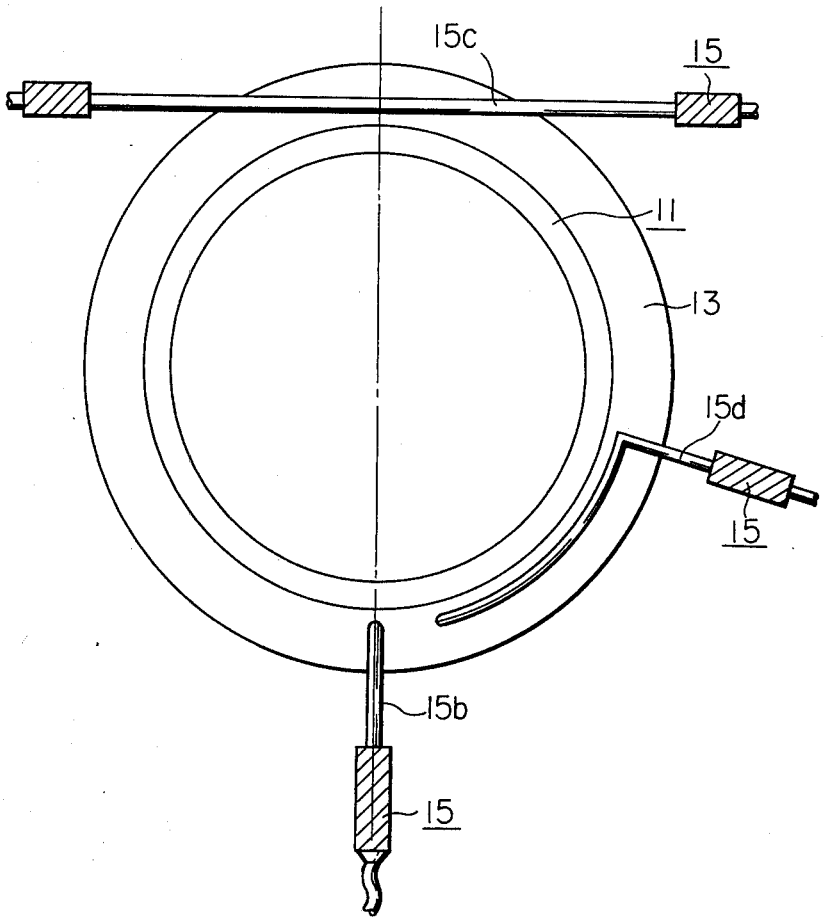
FIG. 6 is a view similar to FIG. 5, but showing different disposing states of different temperature sensors in the heating roller apparatus according to the present invention.

It should be noted that if the outermost wall of the heating roller member 11 is thick enough for forming the groove 13 having the selected depth, it is not necessary to provide a separate lug portion 21. However, it should also be noted that an increase of thickness of the outermost wall makes the heating roller member 11 heavier and, as a result, the cost of power for driving the heating roller member 11 together with a load exerted on the end of the drive shaft 12 must increase. The axial width of the lug portion 21 need not be more than sufficient enough to provide the annular groove 13. Further, the location of the lug portion 21 is preferably selected to be at a portion adjacent to the end face 22 facing the stationary flange 14, as shown in FIGS. 3 and 4. This is because such selected location does not prevent the products to be treated from being wound on the surface 20 and also, makes it easier to form the annular groove 13 as well as the lug portion 21. It will be understood that the annular groove 13 according to the present invention opens on a part of the outer surface 20 of the heating roller member 11, and is grooved substantially toward the center rotating axis of the heating roller member 11. Moreover, the groove 13 is concentric with the drive shaft 12. The purpose of the above-mentioned concentric arrangement of the groove 13 is to prevent occurrence of irregular circumferential distribution of the temperature to be measured by a temperature sensor 15 in the groove 13, and to make it easier to machine the groove 13. As clearly shown in FIGS. 4 and 5, the measuring probe 15*a* of the temperature sensor 15 is stationarily inserted in the groove 13 in a tangential direction with respect to the groove, while lying in a plane perpendicular to the drive shaft 12, so that the measuring probe 15*a* may not contact the inner walls and the bottom surface of the groove 13. Of course, the temperature sensor 15 is stationarily and rigidly held by some means (not shown). Thus, since a sufficient length of the measuring probe 15*a* is inserted in the groove 3, the temperature gradients along the measuring probe 15*a* within the groove 13 can be lessened. As a result, even if the change of disposition of the probe 15*a* within the measuring groove produces a different heat conduction function of the probe 15*a*, a measuring error due to such difference in heat conduction function can be neglected. In this case, by insertion of the measuring probe 15*a* so that the foremost end of the probe 15*a* lies past the center line of the heating roller member 11 by a slight distance, the above-mentioned measuring error can be lessened even more. Numeral 18 in FIG. 5 designates electric lead wires for transmitting electrical signals concerning the temperatures detected by the measuring probe 15*a* of the temperature sensor 15. Numeral 14*a* is a covering which may be formed either separately or integrally with flange 14. The covering 14*a* is provided so as to be concentric with drive shaft 12 while being spaced from the outer surface 20 of the heating roller member 11. That is to say, the inner surface of the covering 14*a* faces the opening of the annular groove 13. The measuring probe 15*a* may be fixedly attached to the covering 14*a* or may be inserted through the covering 14*a* so as to be supported thereby. It will be noted that provision of the covering 14*a* and adjustment of the space between the covering 14*a* of the groove 13, produces even temperature distribution within the groove 13 of the heating roller member 11 and, as a result, precision in measurement of the temperature of the heating roller apparatus is much more improved. In accordance with the experiments by the present inventors, the covering 14*a* is preferably a thin metallic plate made of, for example, copper, steel, aluminum, or an alloy which has relatively small thermal capacity but high thermal conductivity. The measuring probe 15*a* of the temperature sensor 15 may be modified to such embodiments as 15*b*, 15*c* and 15*d* as shown in FIG. 6. Also, the temperature sensor 15 may consist of any known temperature sensor, such as a thermocouple, a thermistor, a resistance thermometer, or a semiconductor element.

In FIG. 6, the measuring probe 15*c* is fixedly supported at two positions on the opposite end parts of the probe 15*c*, and the temperature sensing part of the probe 15*c* is centrally located between the two supported positions. That is to say, the measuring probe 15*c* is suspended in the annular groove 13 of the heating roller member 11 so that the center of the temperature sensing part is aligned with, or lies on, the center line of the heating roller member 11 as shown in FIG. 6. It should be noted that this disposition of the measuring probe 15*c* obviates vibration trouble which might occur when the diameter of the probe 15*c* is small.

The embodiment of the measuring probe 15*d* shows that the probe 15*d* having the shape of a partial circle concentric with the drive shaft 12, is concentrically disposed in the groove 13. This disposition of the measuring probe 15*d* has such disadvantages as, slight mechanical inaccuracy in the installation of the measuring probe 15*d*, the possibility that the probe 15*d* may contact the inner walls or the bottom surface of the groove 13 and difficulty in manufacture of the partial circle-shaped probe 15*d*. However, the disposition of the probe 15*d* has the advantage of being capable of obtaining sufficient insertion length of the measuring probe that error due to change of small insertion length is cancelled.

The embodiment of the measuring probe 15*b* shows that the probe 15*b* is inserted in the groove 13 while being directed toward the center of the heating roller member 11. This disposition allows the easiest installation of the measuring probe, although it has the disadvantage of being unable to obtain a long insertion length.

The present invention and the prior art will hereinafter be compared with reference to the performance characteristics diagrams shown in FIGS. 7A thru 9.

Figure 7B:
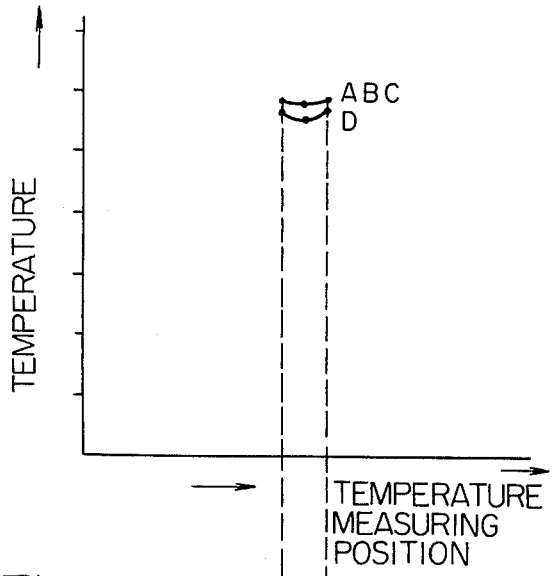
FIGS. 7A and 7B are diagrams illustrating the temperature distribution in the groove for temperature measurement of the heating roller apparatus of FIG. 3.
Figure 7A:
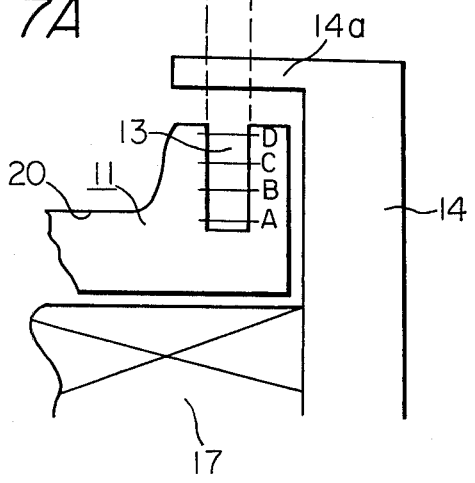

The diagrams of FIGS. 7A and 7B illustrate a relationship between the temperature distribution and the temperature measuring positions located within the groove 13 so as to be parallel with the drive shaft 12. The diagram of FIG. 7B also illustrates differences between temperature distributions using parameters based on changes of measuring position in the direction of the depth of the groove 13. That is to say, the diagrams of FIGS. 7A and 7B concerning the present invention correspond to the diagrams of FIGS. 1A and 1B concerning the prior art. In FIG. 7A, reference character A indicates the deepest position in the annular groove 13, B indicates a position having a depth less than the position A, C indicates a position having a depth less than the position B, and D indicates a position at the opening portion of the groove 13.

The heat transmitted to or generated in the heating roller member 11 by the heat source 17 flows toward the outer surface 20. In the prior art arrangement of the annular groove 3 as shown in FIGS. 1A or 1B, the thermal flows or the heat flows are interrupted or obstructed by the presence of the groove 3 and, as a result, the temperature distributions have extended over broad ranges with respect to both width and depth of the groove 3. On the other hand, according to the present invention, the annular groove 13 is defined as a groove which has an opening on a part of the outer surface 20 of the heating roller member 11 and a depth not penetrating the inner surface of the outermost wall of the heating roller member 11. As a result, the directions of the thermal flows coincide with the direction of extension of the groove 13, so that the temperature distributions with respect to the positions A, B and C are identical as shown in FIG. 7B. The temperature distribution curve at the position D is located below the curve at the places A, B and C, since at the position D, the temperature within the groove 13 must undergo the effect of the environmental temperature and, consequently, the temperatures at D become lower compared with the temperatures at A, B and C. However, it should be noted that difference of temperature distribution is extremely small compared to the prior art heating roller member 1 shown in FIGS. 1A and 2A. In connection with the present invention, the annular groove 13 in the outer surface 20 of the heating roller member 11, for receiving the measuring probe 15*a*, 15*b*, 15*c* or 15*d* may be inclined slightly from an exact radius of the roller member 11, if the inclined groove is aligned with the direction of the thermal flows and does not act as a large obstruction against the thermal flows within the heating roller member 11.

Further, in the prior heating roller member 1, as the annular groove 3 requires sufficient depth in the direction parallel with the drive shaft to receive the measuring probe 5*a*, the temperature distribution must extend over a broad range.

In accordance with the present invention, the annular groove 13 is provided with a width broad enough only to receive the probe without contact between the groove walls and the probe. As a result, the drop in temperature within the groove 13 from the temperature of the inner walls of the groove 13 can be extremely small.

It will now be understood that according to the present invention, the temperature distribution not only in the direction of the groove depth but also in the direction of the groove width can be extremely even compared to that of the prior heating roller apparatus.

Figure 8:
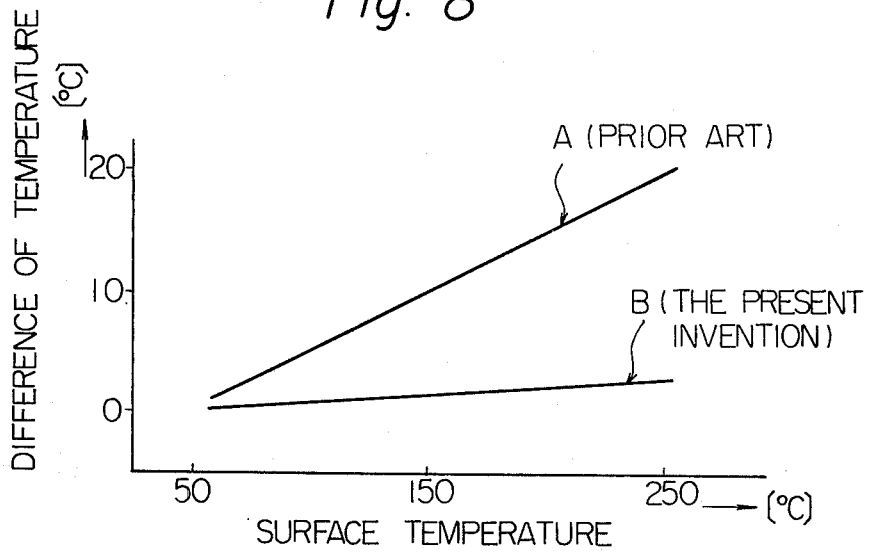
FIG. 8 is a diagram showing the change in difference between the outer surface temperature and the temperature detected in the groove for temperature measurement in response to change of the outer surface temperature of the heating roller with respect to the present invention and the prior art.
Figure 9:
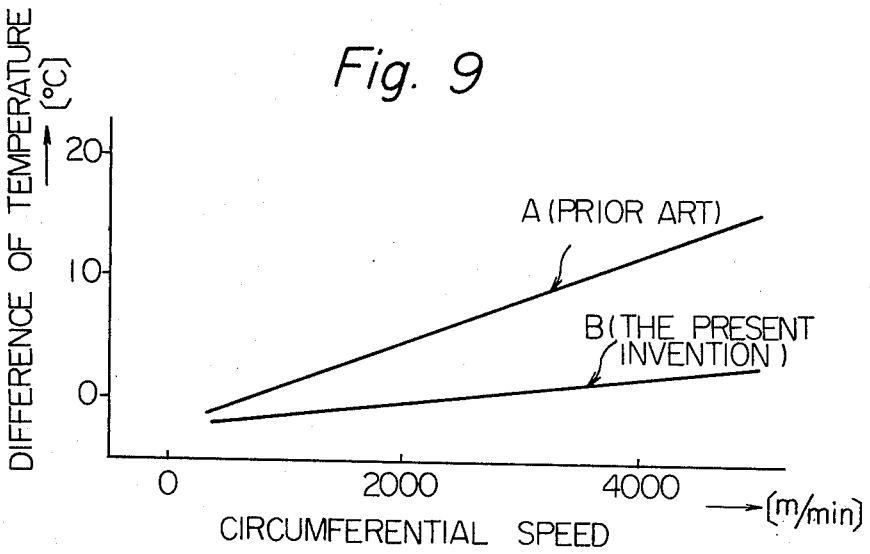
FIG. 9 is a diagram showing the change in difference between the outer surface temperature and the temperature detected in the groove for temperature measurement in response to change of the circumferential speed of the roller member with respect to the present invention and the prior art.

FIGS. 8 and 9 are diagrams illustrating differences between the present invention and the prior art concerning respectively temperature dependence characteristics and speed dependence characteristics of the heating roller apparatuses. In FIG. 8, the abscissa designates the surface temperature of the heating roller member and the ordinate designates a difference between the surface temperature of the heating roller member and the temperature detected by the temperature sensor. In FIG. 9, the absissa designates the circumferential running speed of the heating roller member and the ordinate designates the same as FIG. 8. In FIGS. 8 and 9, the characteristics curves A denote the prior art, while the characteristics curves B denote the present invention. It will be noted that in the prior art, the differences between the outer surface temperature and the average temperature within the groove, that is, the temperature detected by the measuring probe of the temperature sensor, increase in response to increases in the outter surface temperature of the heating roller member or in the circumferential running speed of the heating roller member. Also, it will be noted that the above-mentioned temperature differences themselves of the prior art are larger than the present invention, since the characteristics curves A lie above the curves B. This is because the thermal flows are interrupted or obstructed by the presence of the annular groove of the prior art type.

On the other hand, according to the present invention, the above-mentioned interruption or obstruction of the thermal flows does not occur. As a result, the thermal flows passing through the outer surface of the heating roller member, on which surface the product to be treated contacts, are not different from the thermal flows passing through surfaces around the annular groove. Thus, the differences between the temperature of the outer surface of the heating roller members and the temperature detected by the temperature sensor can be small, and said differences hardly increase, even if the temperature of the outer surface of the heating roller member or the circumferential running speed increases.

The present invention can provide further advantages by provision of the arrangement as explained below.

Figure 10A:
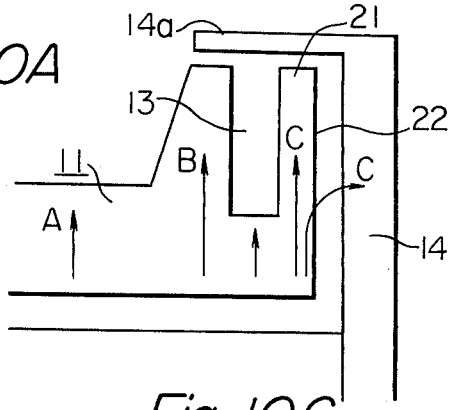
Figure 10B:
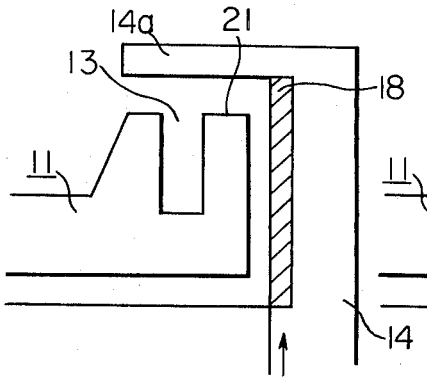
Figure 10C:
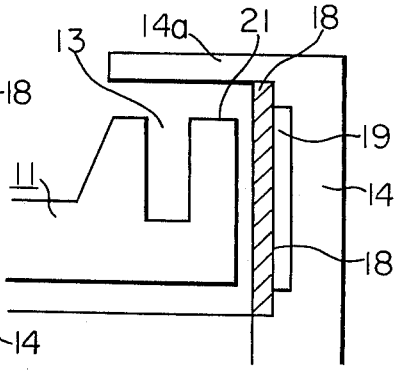
Figure 10D:
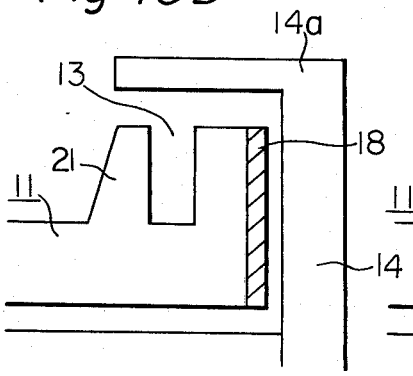
Figure 10E:
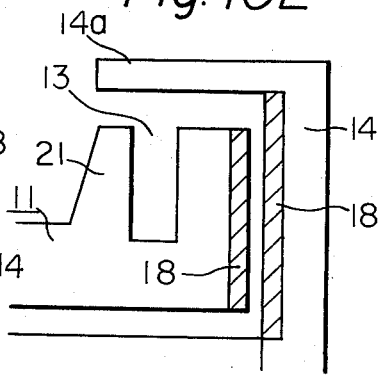

As shown in FIG. 10A, in the heating roller member 11, there are thermal flows in the directions shown by arrows A, B and C. As shown, a part of the thermal flow C branches away to the flange 14 while passing through the end face 22 of the heating roller member 11. The presence of the above branching thermal flow C results in lowering the temperature of the heating roller member 11 in the region where the thermal flow C is present. Consequently, the temperature distribution within the groove 13 becomes uneven and simultaneously, said region of the thermal flow C in the roller member 11 cannot immediately respond to the change of the thermal flow C due to the effect of the thermal capacity of the flange 14. This fact increases an error in temperature measurement and in temperature control of the heating roller apparatus. In order to obviate such disadvantage, a heat insulator 18 is disposed between the end face 22 of the roller member 11 and the stationary flange 14. FIGS. 10B thru 10E illustrate different dispositions of the heat insulator 18. In FIGS. 10B and 10C, the heat insulator 18 is attached to the flange 14 at a part which faces the end face of the roller member 11. It is also possible to provide a cavity 19 between the heat insulator 18 and the flange 14 so that the heat insulating effect may be increased as shown in FIG. 10E. In FIG. 10D, the heat insulator 18 is fixed to the end face 22 of the roller member 11. In this disposition, the heat insulator 18 can not be removable, since the heat insulator 18 rotates together with the heating roller member 11. Finally, in FIG. 10E, the heat insulators 18 are attached to both the heating roller member 11 and the flange 14. It will be understood that at the above-mentioned dispositions of the heat insulator 18 prevent transmission of heat from the roller member 11 to the stationary flange 14. As a result, the previously mentioned disadvantage of FIG. 10A is eliminated.

The most preferable structural conditions according to the present invention will hereinafter be disclosed. In connection with such conditions, reference will be made to FIG. 4 and FIG. 11.

(A) The relationship between the depth and the width of the annular groove of the present invention is:

$$0.6 \leqq D/W \leqq 10 \quad (1)$$

where, D: The depth of the annular groove (mm) (refer to FIG. 4).

W: The width of the annular groove (mm) (refer to FIG. 4).

On the other hand, from the point of view of the capability of machining, the following conditions are preferred.

$$W \geqq 1 \quad (2)$$

$$D \leqq 30 \quad (3)$$

FIG. 11 is a diagram illustrating the scope in which the above conditions (1), (2) and (3) can be satisfied.

In FIG. 11, the abscissa indicates the width (W) of the annular groove 13, and the ordinate indicates the depth (D) of the annular groove 13. That is to say, the shadowed portion in FIG. 11 is the scope satisfying the most preferable structural conditions.

(B) The relationship between the width of the annular groove of the present invention and the diameter of the measuring probe is:

$$0.1 + d \leqq W \leqq 5.0 + d \quad (4)$$

where, *d:* The diameter of the measuring probe (mm) (refer to FIG. 4).

The inequality (4) is determined on the grounds that as the diameter (d) of the probe comes closer to the width (W) of the groove, a better thermal conductivity between the groove walls and the measuring probe can be provided, however, there is a danger that the probe may contact the inner walls of the groove of the rotating heating roller member. On the other hand, when the diameter of the measuring probe is too small compared with the width of the groove, the temperature measuring accuracy of the measuring probe is easily affected by even a slight change of the temperature distribution within the groove. As a result, precise measurement of the temperature of the heating roller apparatus can not be provided.

(C) The relationship between the sectional area of the annular groove of the present invention and the vertically sectional area of the measuring probe is:

$$0.01 \cdot Sm \leqq Sd \leqq 0.8 \cdot Sm \quad (5)$$

where, $Sm = D \times W$: The sectional area of the groove.

$Sd = d^2/4$: The vertically sectional area of the measuring probe.

The above inequality (5) is determined on the grounds that when the vertically sectional area (S*d*) of the probe is extremely small, compared with the sectional area (S*m*) of the groove, the temperature measurement by the probe is easily affected by a slight change of the temperature distribution within the groove. As a result, the temperature detected by the probe changes in response to the change of installation position of the probe. Also, when the vertically sectional area (S*d*) of the probe is too large, the temperature measurement by the measuring probe is easily affected by the temperature distribution around the opening of the groove, and a turbulent flow of the air occurs within the groove.

From the foregoing, it will be understood that the arrangement of the annular groove according to the present invention dos not interrupt or obstruct the thermal flow in the heating roller member, and provides an even temperature distribution within the groove. As a result, the disposition of the temperature measuring probe in such annular groove provides a temperature measurement for the heating roller member in which a difference between the outer surface temperature and the temperature measured by the measuring probe is very small, and; further, said temperature difference does not change, even if the outer surface temperature of the heating roller member or the rotating speed of the roller member changes. From these facts, in accordance with the present invention, a precise measurement of the temperature of the heating roller apparatus along with a precise control of the temperature of the heating roller apparatus can be provided. Further, if a number of the heating roller apparatuses are simultaneously used, differences of the temperatures between different roller apparatuses can be very small. Thus, it will be understood that the present invention can provide very effective advantages over the prior art.

What is claimed is:

1. A heating roller apparatus comprising: a roller member having a cylindrical wall and defining a space in the inside thereof and an annular groove in said cylindrical wall; a rotatably supported drive shaft, means rigidly and concentrically supporting one end of the roller member on an end of the drive shaft; heat source means stationarily positioned in the inner space of the roller member for heating the cylindrical wall, stationary flange means having a support extending into said inner space for supporting said heat source means, said flange means being positioned adjacent the other end of said roller member,; and a temperature sensor having a measuring probe stationarily positioned in the annular groove of the cylindrical wall for measuring a temperature of the cylindrical wall of the roller member, said annular groove being located at a position adjacent to said other end of said roller member and having an opening on the outer surface of said cylindrical wall, and two adjacent circumferentially extending wall faces which penetrate into said cylindrical wall and are substantially perpendicular to the axis of said roller member, said wall faces being spaced from said measuring probe of said temperature sensor; and a metal covering of low thermal capacity and high thermal conductivity extending from said flange means over said opening of said annular groove, said covering facing said opening at a determined distance therefrom and being exposed thereto.

2. A heating roller apparatus as claimed in claim 1, wherein said metal covering is a plate is made of copper.

3. A heating roller apparatus as claimed in claim 1, wherein said metal covering is a plate is made of an alloy.

4. A heating roller apparatus as claimed in claim 1 wherein said heating roller apparatus further comprises heat insulating means attached to a part of said flange means which faces said other end of said roller member.

5. A heating roller apparatus as claimed in claim 4, wherein said heat insulating means attached to said part of said flange means defines a cavity between said heat insulating means and the remaining part of said flange means.

6. A heating roller apparatus as claimed in claim 4, wherein said heating roller apparatus comprises further heat insulating means attached to said other end of said roller member.

7. A heating roller apparatus as claimed in claim 1 wherein said heating roller apparatus further comprises heat insulating means attached to a part of said roller member which faces said flange means.

8. A heating roller as claimed in claim 1, wherein said metal covering is a plate made out of steel.

9. A heating roller apparatus as claimed in claim 1 wherein said metal covering is a plate made out of aluminum.

10. A heating roller apparatus comprising: a roller member having a cylindrical wall and defining a space in the inside thereof and an annular groove in said cylindrical wall; a rotatably supported drive shaft means rigidly and concentrically supporting one end of the roller member on an end of the drive shaft; heat source means stationarily positioned in the inner space of the roller member for heating the cylindrical wall, and a temperature sensor having an elongated measuring probe stationarily positioned to extend in the annular groove of the cylindrical wall for a greater distance than the radial depth of the groove for measuring a temperature of the cylindrical wall of the roller member, said annular groove being located at a position adjacent to the other end of said roller member and having an opening on the outer surface of said cylindrical wall, and two adjacent circumferentially extending wall faces which penetrate into said cylindrical wall and are substantially perpendicular to the axis of said roller member, said wall faces being spaced from said measuring probe of said temperature sensor and a metal covering of low thermal capacity and high thermal conductivity extending over said opening of said annular groove, said covering facing said opening at a determined distance therefrom and being exposed thereto.

11. A heating roller apparatus as claimed in claim 10, wherein the width between said adjacent wall faces of said annular groove and the pentrating depth of said adjacent wall faces of said annular groove have the relationship defined by the inequality of $$0.6 \leqq D/W \leqq 10$$

where (W) designates a dimension of said width between said adjacent wall faces of said annular groove and (D) designates a dimension of said depth of said adjacent wall faces of said annular groove.

12. A heating roller as claimed in claim 11, wherein said width (W) between said adjacent wall faces of said annular groove and said depth (D) of said adjacent wall faces of said annular groove have the further relationship defined by the inequalities of $$W \geqq 1, \text{ and } D \leqq 30$$

13. A heating roller apparatus as claimed in claim 10, wherein said measuring probe of said temperature sensor has a substantially circular shape vertical cross section and further, the width between said adjacent wall faces of said annular groove and the diameter of said circular shape vertical cross section of said measuring probe have the relationship defined by the inequality of $$0.1 + d \leqq W \leqq 5.0 + d$$

where (W) designates a dimension of said width between said adjacent wall faces of said annular groove and (d) designates a dimension of said diameter of said circular shape vertical cross section of said temperature sensor.

14. A heating roller apparatus as claimed in claim 10, wherein an area of an axial cross section of said annular groove and an area of a vertical cross section of said measuring probe of said temperature sensor have the relationship defined by the inequality of $$0.01 \cdot Sm \leqq Sd \leqq 0.8 \cdot Sm$$

where (Sm) designates a value of the area of said axial cross section of said annular groove and (Sd) designates a value of the area of said vertical cross section of said measuring probe of said temperature sensor.

15. A heating roller apparatus as claimed in claim 10, wherein said measuring probe is stationarily and fixedly supported at positions on the opposite end parts thereof so that the temperature sensing part of said measuring probe, which is centrally located between said two supported positions, is disposed in said annular groove while being aligned with the center line of said roller member.

16. A heating roller apparatus as claimed in claim 10, wherein said measuring probe of said temperature sensor has a partially circularly shaped temperature sensing part disposed stationarily in said annular groove concentric with the rotating axis of said roller member.

17. A heating roller apparatus as claimed in claim 10, wherein said measuring probe of said temperature sensor has a straight shape temperature sensing part which is inserted in said annular groove from a tangential direction with respect to said roller member.

18. A heating roller apparatus as claimed in claim 10, wherein said temperature sensor comprises a temperature sensing means selected from the group consisting of a thermocouple, a thermistor, a resistance thermometer, and a semiconductor element, said temperature sensing means being received in said measuring probe.

* * * * *

UNITED STATES PATENT OFFICE

CERTIFICATE OF CORRECTION

Patent No. 3,961,158 Dated June 1, 1976

Inventor(s) Muneharu Tabuchi, et al

It is certified that error appears in the above-identified patent and that said Letters Patent are hereby corrected as shown below:

Column 8, line 48: Change "absissa" to --abscissa--.

Column 11, line 25: Cancel "and".

Column 11, line 2 of Claims 2 and 3: Delete "is" (second occurrence).

Signed and Sealed this

Seventh Day of December 1976

[SEAL]

*Attest:*

RUTH C. MASON
*Attesting Officer*

C. MARSHALL DANN
*Commissioner of Patents and Trademarks*